United States Patent [19]

Lewellin

[11] Patent Number: 4,941,304

[45] Date of Patent: Jul. 17, 1990

[54] INSULATION BODY

[76] Inventor: Richard L. Lewellin, 6 Grimwade Crescent, Frankston, Victoria, 3199, Australia

[21] Appl. No.: 394,973

[22] Filed: Aug. 17, 1989

[51] Int. Cl.[5] ..... E04C 1/10

[52] U.S. Cl. ..... 52/580; 52/588; 52/805

[58] Field of Search ..... 52/793, 802, 805, 580, 52/588

[56] References Cited

U.S. PATENT DOCUMENTS

| | | | |
|---|---|---|---|
| 3,224,155 | 12/1965 | Rook . | |
| 3,372,520 | 3/1968 | Hensel . | |
| 3,535,844 | 10/1970 | Glaros | 52/802 X |
| 4,186,539 | 2/1980 | Harmon et al. | 52/588 X |
| 4,192,117 | 3/1980 | Heirich | 52/588 X |
| 4,236,366 | 12/1980 | Rijnders | 52/580 X |
| 4,267,679 | 5/1981 | Thompson | 52/805 X |

FOREIGN PATENT DOCUMENTS

| | | | |
|---|---|---|---|
| 728742 | 11/1942 | Fed. Rep. of Germany | 52/588 |
| 365519 | 12/1962 | Switzerland | 52/809 |

*Primary Examiner*—David A. Scherbel
*Assistant Examiner*—Lan Mai
*Attorney, Agent, or Firm*—Ross, Ross & Flavin

[57] ABSTRACT

An insulation panel having back and front faces spaced apart parallel to each other. A female edge has a recessed region along part of its length and a male edge has a complementary shape to the recessed region of the female edge so as to closely fit within the female edge of an adjacent similar insulation panel. A web extends across the distance separating the back and the front faces, the web being formed integrally with one of the faces. The female edge is generally channel shaped and has a base wall being defined by the web, the front wall comprising an edge portion of the front face which is turned inwardly towards the back face and then turned back upon itself to define a double thickness front wall of the channel shape, the edge portion of the front face turning to extend towards the back face so as to define the web. The male edge is also channel shaped but is stepped in so as to define a narrower width channel shape to fit within the female edge channel shape. The web at the female edge and the base wall at the male edge are integral with the front face of the panel, the back face of the panel being provided with edge portions which are turned in and towards the front face and then turned back on themselves to receive therein the edges of the front face which are themselves finally turned outwardly to form the outer walls of the female edge and male edge channel shapes.

11 Claims, 1 Drawing Sheet

INSULATION BODY

This invention relates to insulation bodies, particularly although not exclusively to insulation panels of the kind used in bulding constructions, e.g. for thermally insulating cool rooms or providing acoustic insulation.

Insulation panels used say for insulating the walls of cool rooms or the like and for acoustic insulation are known. Such panels are arranged to be assembled together in a modular form. Each panel has a back and front face which are spaced apart and are generally parallel to each other. It is also known to provide each such panel with a female edge having a recessed region along part of its length and a male edge opposite to the female edge and which has a complementary shape to the recessed region of the female edge so as to closely fit in the female edge of an adjacent similar panel. The present invention relates to insulation panels of this kind and such panels will be conveniently referred to hereinafter as insulation panels of the kind defined.

The known insulation panels of the kind defined can have several types of construction. One construction comprises back face and front face sheets which are turned back upon themselves so as to engage and be secured to the opposite edges of two outwardly facing channel members which define the female edge and the opposite male edge. The manufacturing assembly of this kind of panel is time consuming making the panel relatively expensive. This kind of panel is illustrated in FIG. 1 of the drawings.

Another known kind of insulation panel of the kind defined has back and front faces which have edge formation which are integral with the back and front faces. The egde formations terminate in planar webs which extend at right angles to the general planes of the back and front faces so that the web of the back face can be overlapped with the adjacent web of the front face and the two webs secured together e.g. by the welding or riveting. The webs at both the male and female edges are overlapped and secured together. Again this kind of insulation panel is relatively time consuming to construct because of the difficulty of working with the overlapped webs and particularly securing of the webs together. Furthermore this kind of overlapped construction provides an area of weakness which can result in fracturing of the connection between the back and front faces when the panel is being handled and particularly when any twisting forces may be applied to the panel during handling. This second known kind of insulation panel is illustrated in FIG. 2 of the accompanying drawings.

It is an object of the present invention to provide an insulation panel of the kind defined which is relatively simple and efficient to manufacture and which has improved structural strength.

According to the present invention there is provided an insulation panel having a back face and a front face, the back and front faces being spaced apart and being generally parallel to each other, the panel including a female edge having a recessed region along part of its length and a male edge opposite the female edge and which has a complementary shape to the recessed region of the female edge so as to closely fit within the female edge of an adjacent similar insulation panel, at least one of the female and male edges being provided with a web which extends across substantially the entire distance separating the back and the front faces, the web being formed integrally with one of the back and front faces.

Preferably the web extends across the entire width of the recessed region of the female edge. There may be provided a web at both the male and female edges, both webs being formed integrally with the same one of the front and back faces of the panel.

Preferably there are provided two webs, one at the male edge and one at the female edge, each web being integral with a respective one of the front and back faces of the panel.

Possible and preferred features of the present invention will now be described with particular reference to the accompanying drawings. However it is to be understood that the features illustrated in and described with reference to the drawings are not to be construed as limiting on the scope of the invention. In the drawings.

Figure 3:
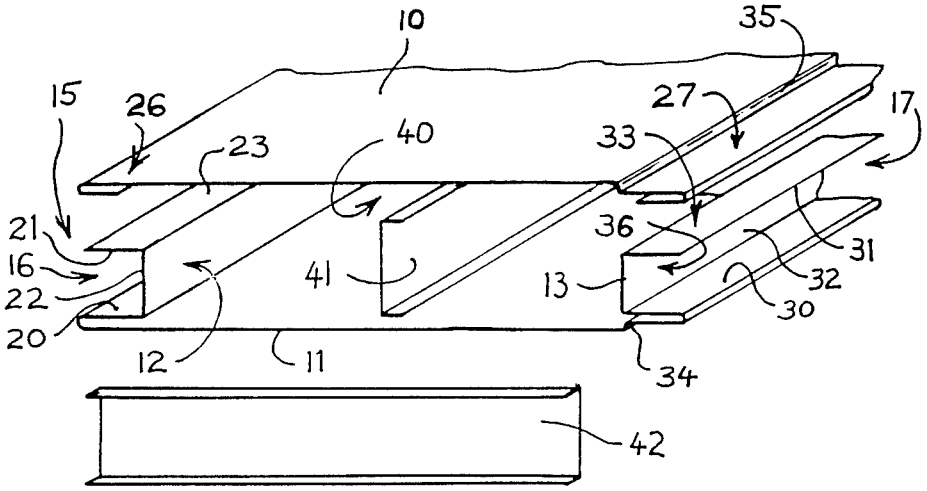
FIG. 3 is a perspective exploded sectional view through an insulation panel according to an embodiment of the present invention.
Figure 4:
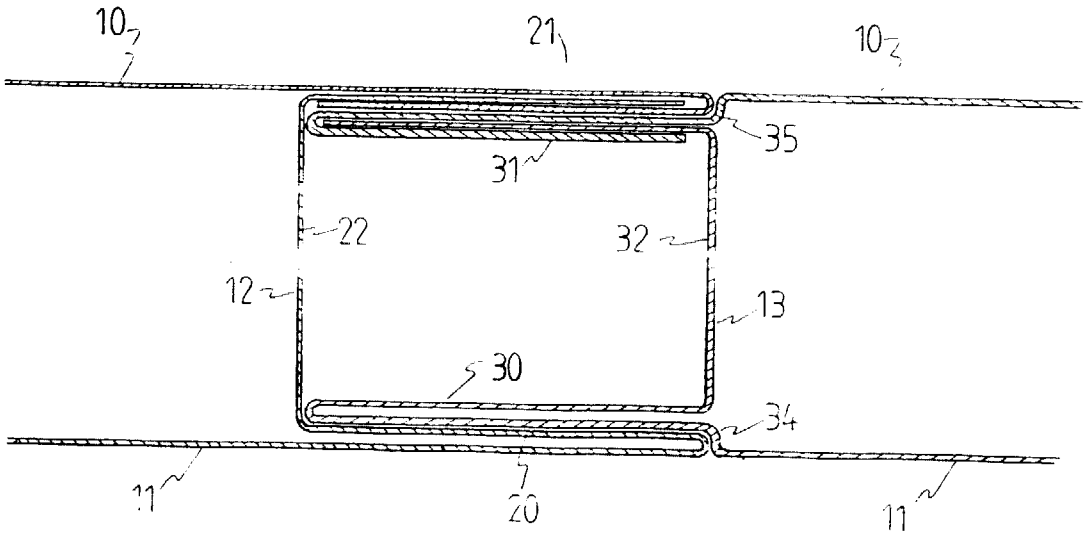
FIG. 4 shows a cross sectional view through the region where two similar adjacent panels constructed as shown in FIG. 3 are fitted together.

The insulation panel according to the present invention and illustrated in FIGS. 3 and 4 has a back face 10 and a front face 11 and webs 12, 13 formed integrally with the front face 1. The webs 12, 13 extend across substantially the entire width of the recessed region 16 of the female edge 15.

Figure 1:
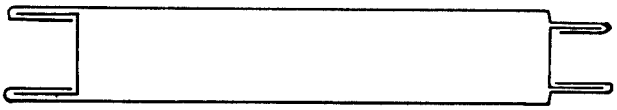
Fig. 1 (Prior Art)
FIG. 1 is a cross sectional view through an insulation panel known at the present time.
Figure 2:
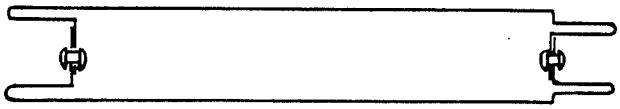
Fig. 2 (Prior Art)
FIG. 2 is a similar cross sectional view through another known insulation panel.

Although in the preferred embodiment illustrated, the insulation panel is provided with a web 12, 13 at both male and female edges 15, 17 and both webs 12, 13 are formed integral with the same face 11 of the panel, in an alternative possibility one web could be provided integral with a respective one of the faces 10, 11 of the panel, i.e. one web provided on one of the back and front faces 10, 11 at the female edge 15 and the remaining face being provided with a web at the male edge 17. In a further possible embodiment (not illustrated) there may be provided a web at one edge integral with either the back or the front face 10, 11, the formation at the other edge including a separate member (such as in FIG. 1) which extends between and spaces the back and front faces.

The recessed region 16 of the female edge 15 is of generally channel shape and the channel shape extends along the entire length of the female edge 15. The channel shape is defined by a front wall 20, a back wall 21 and a base wall 22, the base wall 22 being defined by web 12. The front wall 20 of the channel shape comprises an edge of the front face 11 which is turned inwardly, i.e. towards the back face 10, and then back upon itself to define a double thickness channel wall 20. That is, the outer thickness of the double thickness channel wall 20 comprises the front face 11 of the panel and the inner thickness of the channel wall 20 is defined by the edge portion being turned back upon the front face 11, the edge portion then being turned to extend towards the back face 10 so as to define the web 12. In this embodiment the back wall 21 of the channel shape is defined by the edge portion being turned outwardly at 23 to extend parallel to the other channel wall, i.e. the front wall 20.

The male edge 17 is defined by a projecting portion which is elongated so as to extend the length of the panel at the male edge 17, the projecting portion being arranged to fit in the female edge 15 having the channel shape. The male edge 17 is generally similar in formation to the female channel, i.e. being generally channel shaped and having front and back walls 30, 31 and a base wall 32 defining web 13. The front and back walls 30, 31 of the male channel shape are however stepped in towards each other at 34, 35 so as to define a narrower width channel shape 36 which is arranged to fit within the wider female edge channel shape 16. The steps 34, 35 are provided in the back and front faces 10, 11 along and a short distance in from the extreme edge so as to allow the opposite walls 20, 21 of the female channel shape 16 to closely receive the walls 30, 31 of the male channel shape 17 so that the outer surfaces of the back and front faces 10, 11 of interconnected similar insulation panels are substantially coplanar.

The webs 12, 13 are provided on the front face 11 of the panel. The back face 10 has edge portions 26, 27 which are turned in, i.e. towards the front face 11, and then back upon themselves to receive therein the edges 23, 33 of the front face 11 which are themselves finally turned outwardly to form the outer walls 21, 31 of the female and male edge channel shapes 16, 17. The back face 10 is stepped downwardly at 35 before being turned inwardly at 27 and back upon itself.

The edges 23, 26 and 33, 27 of the front and back faces 11, 10 when coupled together in the way described may be fastened together in any convenient manner. For example the edges may be riveted, clamped, welded or the like. These operations can be carried out readily since the connection points will be along an outstanding flange completely accessible from outside of the panel.

The provision of webs 12, 13 extending across the entire width of channel shapes 16, 17 at the female and male edges 15, 17 provide considerable strength compared to the riveted or otherwise joined overlapped webs in the prior art. Also this construction enables the panel to be readily assembled, e.g. by sliding the back face 10 along the length of the front face 11 with the edges of the faces being received together as described above. After this the front and back faces 11, 10 can be readily fastened together.

The cavity 40 defined between the front and back faces 10, 11 may include a generally 'U' shaped reinforcing channel 41 which is provided along the length of the panel generally parallel to the female and male edges 15, 17 and spaced midway between those edges. This type of reinforced construction is know in the art. Top and bottom edges of the panel may be defind by channel members 42 received between the front and back faces as is known.

Insulation material of any desired kind may be incorporated in or added to the cavity 40. For example fibreglass, rockwool or foamed insulation may be provided depending on the intended use of the panel as is know in the art. The particular panel construction according to the present invention in fact enables insulation material to be added to the cavity 40 before the front and back faces 10, 11 are assembled and secured together. For example the front face 11 may be laid flat so that the opposed webs 12, 13 at the male and female edges define side walls of the cavity 40. The top and bottom walls of the cavity 40 may be defined by outwardly facing channel members 42 at the top and bottom edges of the panel as is known in the art so that the panel as a whole has a generally enclosed cavity except for an upper face. This cavity 40 can be filled with insulation material, preferably a compressible insulation material to a height slightly beyond the depth of the cavity. The back face 10 may then be slid onto the front face 11 with the edges being coupled together as desired, the insulation material being compressed slightly between the back and front faces 10, 11 as the faces are assembled together.

The back and front faces 10, 11 may be made of any suitable material such as aluminium sheeting or any other suitable material. The faces or one of the faces may be perforated, particularly in the case of acoustic insulation panels as is know in the art.

The insulation panel according to the preferred embodiment of the present invention as described above will enable the panel to be rolled so that the panel can be curved along its length, i.e. along the length parallel to the female and male edges 15, 17. The provision of the webs 12, 13 without any fastenings along the webs will provide sufficient strength to the panel to enable this rolling operation to be carried out. The curved insulation panel therefore may be suitable for constructing roofing, say of sheds or buildings requiring insulation. This kind of roofing may be particularly suitable for sheds for intensive breeding and raising of animals.

Further to the preceding description, the panel can have any suitable dimensions depending on the materials and functions of the panel. The thickness of the panel and the length of the channel walls are variable again depending upon materials, uses etc.

The front and back faces and the edge formations of the panel according to the invention may be made by any convenient technique, such as roll forming of sheet metal.

The manufacturing assembly and fastening of the faces of the panel according to the preferred embodiment can be relatively simple particularly in relation to the fastening of the faces together when compared to the prior art. In use when the panels according to the present invention are assembled together, the assembly is completely demountable enabling the panels to be rearranged and reused as desired. The panel is also relatively strong to the extent that the panel can be rolled if desired to have a curved shape, say for use as roofing of insulated structures.

In the preceding description of the preferred embodiment the webs 12, 13 are provided on the front wall 11 of the panel. However the use of the expressions "front" and "back" are arbitrary and are not intended to be limiting upon the invention.

It is to be understood that various alterations, modifications and/or additions may be made to the features of the possible and preferred embodiment(s) of the invention as herein described without departing from the scope of the invention as defined in the appended claims.

I claim:

1. An insulation panel having a back face and a front face, the back and front faces being spaced apart and being generally parallel to each other, the panel including a female edge having a recessed region along its length, the panel further including a male edge located at the opposite side of the panel to the female edge and which has a male shape which is complementary to the recessed region of the female edge so as to closely fit within the female edge of an adjacent similar insulation panel, the front face having two integral webs located at and extending respectively along the female and male edges of the panel, each web extending across substantially the entire distance separating the back and front faces so as to define a cavity within the panel, the cavity having a base wall defined by the front face and two opposed side walls defined by the webs at the female and male edges of the panel so that the cavity can receive and retain an insulating material filling for the panel, the web at the female edge of the panel being shaped so as to define the recessed region, the web at the male edge of the panel being shaped so as to define the male shape, each web having an edge portion remote from the front face and which turns out of the general plane of the web, the edge portions of the webs being secured to the back face of the panel.

2. An insulation panel as claimed in claim 1 wherein the recessed region of the female edge is generally channel shaped, the channel shape being defined by a front wall, a back wall and a base wall, the front wall of the channel shape comprising an edge portion of the front face which is turned inwardly towards the back face and then turned back upon itself to define a double thickness front wall of the channel shape, the edge portion of the front face being further turned to extend towards the back face so as to define the web and form the base wall of the channel shape.

3. An insulation panel as claimed in claim 2 wherein the web at the male edge is arranged to fit within the channel shape of the female edge, the male edge being generally channel shaped and having front and back walls and a male edge base wall extending across the distance between the front and back walls of the male edge channel shape, the front and back walls of the male edge channel shape defining a channel shape having a width to fit within the female edge channel shape.

4. An insulation panel as claimed in claim 3 wherein the front and the back faces of the panel are stepped towards each other to define the male edge channel shape, the step in each of the front and back faces extending along and being spaced a short distance from the extreme edge of the respective front or back face as to allow the front and back walls of the female edge channel shape to closely receive the front and back walls of the male edge channel shape and so that the outer surfaces of the front and back faces of interconnected similar insulation panels are substantially coplanar.

5. An insulation panel as claimed in claim 3 or 4 wherein the back face of the panel is provided with edge portions which are turned in and towards the front face and then turned back on themselves to receive therein the edge portions of the webs which are themselves turned outwardly to form the respective back walls of the female edge channel shape and the male edge channel shape.

6. An insulation panel as claimed in claim 1 wherein the insulation material filling is placed in position in the cavity before the front and back faces are assembled and secured together, the panel being assembled by filling of the cavity with a compressible insulation material filling to a height slightly beyond the thickness of the cavity followed by assembly of the back and front faces together with the insulation material filling being compressed as the front and back faces are assembled together.

7. An insulation panel as claimed in claim 1 wherein one or each of the front and back faces is composed of a perforated sheet material so that the panel provides acoustic insulation with the perforated face sheet material allowing penetration of sound waves into the cavity.

8. An insulation panel having a back face and a front face, the back and front faces being spaced apart and being generally parallel to each other, the panel including a female edge having a recessed region along its length, the panel further including a male edge located at the opposite side of the panel to the female edge and which has a male shape which is complementary to the recessed region of the female edge so as to closely fit within the female edge of an adjacent similar insulation panel, the front face having two integral webs located at and extending respectively along the female and male edges of the panel, each web extending across substantially the entire distance separating the back and front faces so as to define a cavity within the panel, the cavity having a base wall defined by the front face and two opposed side walls defined by the webs at the female and male edges of the panel so that the cavity can receive and retain an insulating material filling for the panel, the web at the female edge of te panel being shaped so as to define the recessed region, the recessed region of the female edge being generally channel shaped, the channel shape being defined by a front wall, a back wall and a base wall, the front wall of the channel shape comprising an edge portion of the front face which is turned inwardly towards the back face and then turned back upon itself to define a double thickness front wall of the channel shape, the edge portion of the front face being further turned to extend towards the back face so as to define the web and form the base wall of the channel shape, the web at the male edge of the panel being shaped so as to define the male shape which fits within the channel shape of the female edge, the male edge being generally channel shaped and having front and back walls and a male edge base wall extending across the distance between the front and back walls of the male edge channel shape, the front and back walls of the male edge channel shape defining a channel shape having a width to fit within the female edge channel shape, each web having an edge portion remote from the front face and which turns outwardly of the general plane of the web to form the respective back walls of the female edge channel shape and male edge channel shape, the back face of the panel being provided with edge portions which are turned in and towards the front face and then turned back on themselves to receive therein the edge portions of the webs, the edge portions of the webs and the edge portions of the back face being secured together.

9. An insulation panel as claimed in claim 8 wherein the front and the back faces of the panel are stepped towards each other to define the male edge channel shape, the step in each of the front and back faces extending along and being spaced a short distance from the extreme edge of the respective front or back face as to allow the front and back walls of the female edge channel shape to closely receive the front and back walls of the male edge channel shape and so that the outer surfaces of the front and back faces of interconnected similar insulation panels are substantially coplanar.

10. An insulation panel as claimed in claim 8 or 9 wherein the insulation material filling is placed in position in the cavity before the front and back faces are assembled and secured together, the panel being assembled by filling of the cavity with a compressible insulation material filling to a height slightly beyond the thickness of the cavity followed by assembly of the back and front faces together with the insulation material filling being compressed as the front and back faces are assembled together.

11. An insulation panel as claimed in claim 8 wherein one or each of the front and back faces is composed of a perforated sheet material so that the panel provides acoustic insulation with the perforated face sheet material allowing penetration of sound waves into the cavity.

* * * * *

UNITED STATES PATENT AND TRADEMARK OFFICE

CERTIFICATE OF CORRECTION

PATENT NO. : 4,941,304

DATED : July 17, 1990

INVENTOR(S) : Richard L. Lewellin

It is certified that error appears in the above—identified patent and that said Letters Patent is hereby corrected as shown below:

In the drawings, add Fig. 4 as shown on the attached sheet.

Signed and Sealed this

Fifth Day of November, 1991

*Attest:*

HARRY F. MANBECK, JR.

*Attesting Officer*

*Commissioner of Patents and Trademarks*